US010924861B2

(12) United States Patent
Chen et al.

(10) Patent No.: US 10,924,861 B2
(45) Date of Patent: Feb. 16, 2021

(54) SPEAKER

(71) Applicant: AAC Technologies Pte. Ltd., Singapore (SG)

(72) Inventors: Aixin Chen, Shenzhen (CN); Minmin Chen, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/527,072

(22) Filed: Jul. 31, 2019

(65) Prior Publication Data

US 2020/0045427 A1 Feb. 6, 2020

(30) Foreign Application Priority Data

Aug. 4, 2018 (CN) ..... 201821261894.X

(51) Int. Cl.
*H04R 7/18* (2006.01)
*H04R 7/12* (2006.01)
*H04R 9/06* (2006.01)

(52) U.S. Cl.
CPC ..... *H04R 7/18* (2013.01); *H04R 7/127* (2013.01); *H04R 9/06* (2013.01); *H04R 2307/025* (2013.01); *H04R 2307/027* (2013.01)

(58) Field of Classification Search
CPC . H04R 7/18; H04R 7/127; H04R 9/06; H04R 2307/025; H04R 2307/027
USPC ..... 381/398
See application file for complete search history.

(56) References Cited

U.S. PATENT DOCUMENTS

2004/0188174 A1* 9/2004 Sahyoun ..... H04R 9/045 181/157
2005/0226459 A1* 10/2005 Tomiyama ..... H04R 7/18 381/424
2006/0062422 A1* 3/2006 Ono ..... H04R 31/003 381/424
2013/0156237 A1* 6/2013 Kim ..... H04R 31/00 381/191

* cited by examiner

*Primary Examiner* — Sean H Nguyen
(74) *Attorney, Agent, or Firm* — W&G Law Group LLP

(57) ABSTRACT

A speaker is provided, including a holder, a diaphragm fixed to the holder, and a voice coil located under the diaphragm and configured to drive the diaphragm to vibrate to sound. The diaphragm includes a diaphragm body, a protruding portion extending from the diaphragm body while being bent towards the voice coil, and a dome fitted to the protruding portion. The protruding portion includes a first wall and a second wall connected to the first wall and parallel to the diaphragm body. The diaphragm body is provided with a suspension disposed around the dome. The speaker of the present disclosure has the diaphragm of an improved structure, which greatly increases the adhesion between the dome and the diaphragm, effectively improves the reliability of the product, reduces the total harmonic distortion, and improves the acoustic performance of the product.

8 Claims, 2 Drawing Sheets

SPEAKER

TECHNICAL FIELD

The present disclosure relates to the field of electroacoustic technologies, and in particular, to a speaker.

BACKGROUND

An electroacoustic device is a component in the field of electronics. With the development of the electronics industry, electroacoustic systems need to constantly meet higher demands of consumers on product performance, and need to present the essence of sound more perfectly.

A diaphragm is a core sounding component of a speaker, and its design directly affects the acoustic performance of the speaker. An existing speaker 10' includes a holder 11', a diaphragm 13' fixed to one side of the holder 11', a voice coil 15' for driving the diaphragm 13' to vibrate to sound, and a magnetic circuit unit 12' located under the diaphragm 13' and fixed to the holder 11'. The diaphragm 13' and a dome 16' are separated and glued together (see FIG. 1 for details). The speaker having the above structure has the following problems: the gluing process between the dome and the diaphragm cannot be omitted, the adhesion is insufficient, the dome is easily detached from the place where the dome and the diaphragm are glued, or the dome is easily separated from the diaphragm, which cannot meet the waterproof requirement of 50 meters. However, the detachment of the dome or the separation of the dome from the diaphragm may affect the reliability, and even swinging and distortion may occur when the diaphragm vibrates, so good acoustic performance cannot be obtained.

Therefore, it is necessary to provide a new speaker with an improved diaphragm structure.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

In order to solve the problem that the dome is easily detached from the place where the dome and the diaphragm are glued or the dome is easily separated from the diaphragm due to insufficient adhesion between the dome and the diaphragm, the present disclosure improves the structure of the diaphragm 13. The specific solution is described as follows.

Figure 1:
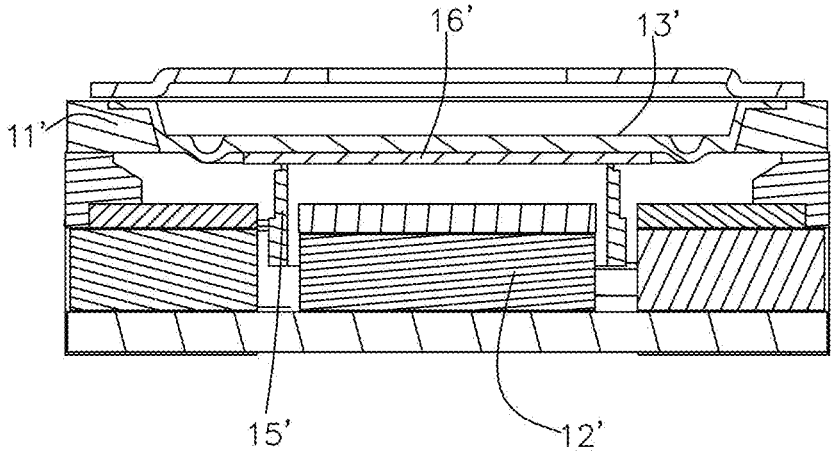
FIG. 1 is a schematic cross-sectional structural diagram of a speaker in the prior art.
Figure 2:
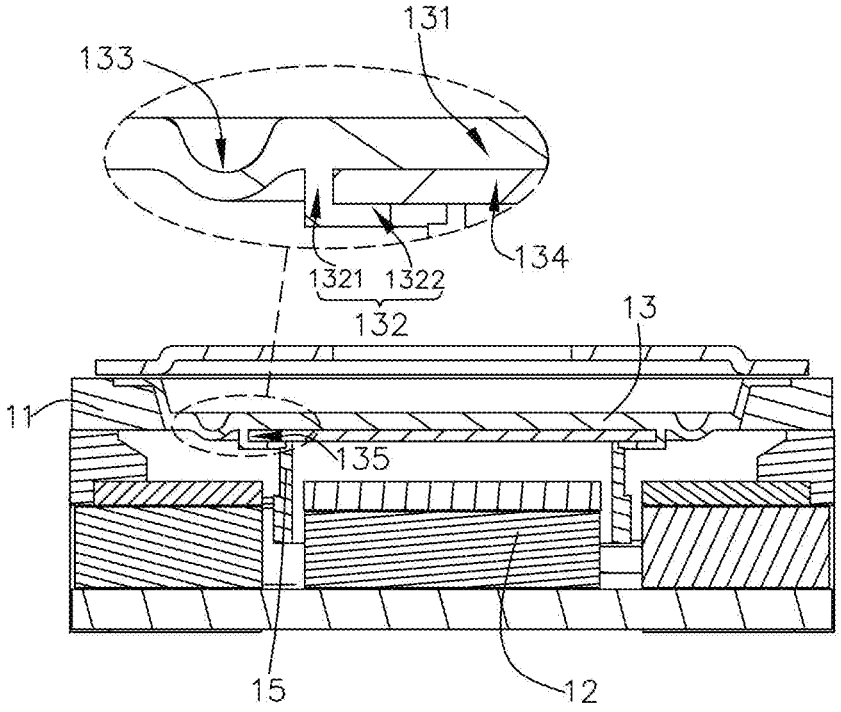
FIG. 2 is a schematic cross-sectional structural diagram of a speaker according to the present disclosure.
Figure 3:
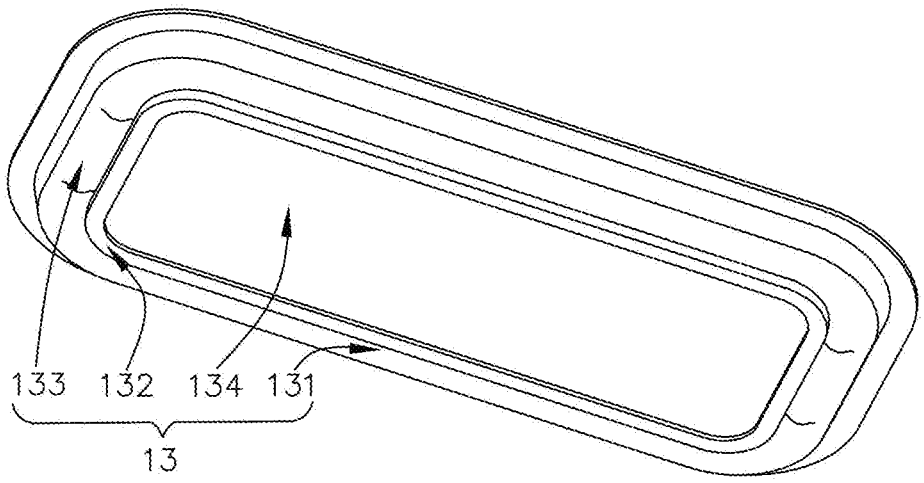
FIG. 3 is a perspective schematic diagram of a speaker according to the present disclosure.

As shown in FIG. 2 and FIG. 3, a speaker 10 having a diaphragm of a new structure is provided. The speaker 10 includes a holder 11, a diaphragm 13 fixed to the holder 11, a voice coil 15 located under the diaphragm 13 and used for driving the diaphragm 13 to vibrate to sound, and a magnetic circuit unit 12 located under the diaphragm 13 and fixed to the holder 11. The diaphragm 13 includes a first surface provided with a protruding portion and a second surface opposite to the first surface. The diaphragm 13 includes a diaphragm body 131, a protruding portion 132 bending and extending from the diaphragm body 131 in a direction towards the voice coil 15, and a dome 134 fitted to the protruding portion 132.

In this embodiment, the diaphragm body 131 includes a suspension 133 bending and extending downward from the diaphragm body 131 and disposed around the dome 134. The diaphragm body 131 further includes the protruding portion 132 protruding outward from a lower surface (the first surface). The protruding portion 132 includes a first wall 1321 disposed perpendicular to the diaphragm body 131, and a second wall 1322 disposed parallel to the diaphragm body 131 and perpendicular to the first wall 1321. The protruding portion 132 has an L-shaped cross-section, but other shapes are also available. See FIG. 2 for details.

Further, the protruding portion 132 and the diaphragm body 131 form a receiving groove 135, and a peripheral end of the dome 134 is fitted to the receiving groove 135. Specifically, the first wall 1321 is used for limiting movement of the dome 134 in the horizontal direction (i.e., the left-right direction in the figures). The dome 134 is sandwiched between the second wall 1322 and the diaphragm body 131, and thus movement of the dome 134 in the vertical direction (i.e., the up-down direction in the figures) is limited. In addition, the dome 134 is glued to the first surface of the diaphragm body 131, which further increases the adhesion between the dome 134 and the diaphragm body 131. Therefore, the above structure greatly increases the adhesion between the dome 134 and the diaphragm 13, effectively improves the reliability of the product, and meets the waterproof requirement of 50 meters.

In this embodiment, the protruding portion 132 is disposed in a central region of the diaphragm body 131, and the protruding portion 132 is disposed at a position closer to a center side of the diaphragm body 131 than the suspension 133. In this embodiment, the protruding direction of the suspension 133 is the same as the protruding direction of the protruding portion 132. However, the present disclosure is not limited thereto, and the protruding direction of the suspension 133 may be opposite to the protruding direction of the protruding portion 132. In addition, the dome 134 has a rounded rectangular shape, and the protruding portion 132 and the suspension 133 are both of an annular shape. The dome 134 may have other shapes such as an ellipse or a polygon.

In addition, the diaphragm body 131 is made of a polymer material or a silica gel material, the protruding portion 132 is made of plastic or metal, and the dome 134 is made of a steel material or an aluminum foil. However, the present disclosure is not limited thereto, the diaphragm body 131, the protruding portion 132, and the dome 134 may also be made of other materials.

Compared with the prior art, the speaker of the present disclosure has the diaphragm of an improved structure, which greatly increases the adhesion between the dome and the diaphragm, effectively improves the reliability of the product, reduces the total harmonic distortion, and improves the acoustic performance of the product.

It should be noted that various modifications and changes may be made by those of ordinary skill in the art without departing from the creative concept of the present disclosure, and these modifications and changes all fall within the protection scope of the present disclosure.

What is claimed is:

1. A speaker, comprising:

a holder, a diaphragm fixed to the holder, the diaphragm comprising a diaphragm body, a protruding portion and a dome, and a voice coil located under the diaphragm and configured to drive the diaphragm to vibrate to sound, wherein the protruding portion extends from the diaphragm body while being bent towards the voice coil, and the dome is fitted to the protruding portion; the protruding portion comprises a first wall and a second wall connected to the first wall and parallel to the diaphragm body; and the diaphragm body is provided with a suspension disposed around the dome; the first wall, the second wall and the diaphragm body form a receiving groove, and the dome is fitted to the receiving groove.

2. The speaker as described in claim 1, wherein the protruding portion is disposed at a central region of the diaphragm body, and the protruding portion is disposed at a position closer to a center side of the diaphragm body than the suspension.

3. The speaker as described in claim 1, wherein the first wall is perpendicular to the diaphragm body and perpendicular to the second wall.

4. The speaker as described in claim 3, wherein the second wall protrudes from an end of the first wall facing away from the diaphragm body in a direction facing away from the suspension.

5. The speaker as described in claim 1, wherein the diaphragm body is made of a polymer material or a silica gel material.

6. The speaker as described in claim 1, wherein the protruding portion is made of plastic or metal.

7. The speaker as described in claim 1, wherein the dome is made of a steel sheet or an aluminum foil.

8. The speaker as described in claim 1, wherein the dome is bonded to the diaphragm body by adhesion.

* * * * *